US009523210B2

(12) United States Patent
Hargis

(10) Patent No.: US 9,523,210 B2
(45) Date of Patent: Dec. 20, 2016

(54) POOL SKIMMER

(71) Applicant: Calvin Hargis, Warwick, NY (US)

(72) Inventor: Calvin Hargis, Warwick, NY (US)

( * ) Notice: Subject to any disclaimer, the term of this patent is extended or adjusted under 35 U.S.C. 154(b) by 403 days.

(21) Appl. No.: 13/739,407

(22) Filed: Jan. 11, 2013

(65) Prior Publication Data

US 2014/0197115 A1 Jul. 17, 2014

(51) Int. Cl.

| | |
|---|---|
| ***E04H 4/12*** | (2006.01) |
| *E06B 9/54* | (2006.01) |
| *B65H 16/00* | (2006.01) |
| *E06B 9/08* | (2006.01) |

(52) U.S. Cl.

CPC ..... *E04H 4/1272* (2013.01); *E04H 4/1254* (2013.01); *B65H 16/005* (2013.01); *E06B 9/08* (2013.01); *E06B 2009/543* (2013.01); *Y10T 29/49826* (2015.01)

(58) Field of Classification Search

None

See application file for complete search history.

(56) References Cited

U.S. PATENT DOCUMENTS

| | | | | |
|---|---|---|---|---|
| 4,472,842 A | | 9/1984 | Jarrett | |
| 4,480,800 A | * | 11/1984 | Oberg | E02B 15/08 210/923 |
| 4,557,001 A | | 12/1985 | Burkhart | |
| 4,836,920 A | | 6/1989 | Miller, Jr. | |
| 5,085,767 A | | 2/1992 | Beers | |
| 5,139,660 A | | 8/1992 | Lourie et al. | |
| 5,223,135 A | | 6/1993 | MacPhee et al. | |
| 5,332,021 A | * | 7/1994 | Todd | A47K 3/38 160/133 |
| 5,951,858 A | | 9/1999 | Soto et al. | |
| 6,375,164 B1 | * | 4/2002 | Siegler | E01F 13/028 256/1 |
| 6,435,250 B1 | * | 8/2002 | Pichik | E06B 9/02 160/24 |
| 6,776,398 B1 | * | 8/2004 | Tsai | E01F 13/028 256/37 |
| 6,854,505 B2 | * | 2/2005 | Grubb et al. | 160/296 |
| 6,905,275 B1 | * | 6/2005 | Del Valle | B43K 23/126 401/195 |

(Continued)

FOREIGN PATENT DOCUMENTS

CA WO 2012/058744 A1 * 5/2012 ..... E04H 17/18

*Primary Examiner* — Bobby Ramdhanie
*Assistant Examiner* — Michael An
(74) *Attorney, Agent, or Firm* — Howson & Howson, LLP

(57) ABSTRACT

A device for skimming a pool surface to collect floating debris includes an elongate handle, a hollow body, and a spool on which an elongate continuous length of webbing is wound in a spiral configuration. The spool is housed within the body and the webbing is extendable from the spool through a slot formed in the body and is retractable onto the spool through the slot via spool rotation. The webbing has a proximal end to which an end piece is connected. The end piece is shaped to prevent passage through the slot and has a fastening element for being secured to an edge of a pool structure for removably mounting the end piece to the structure. The handle and body are sufficiently portable and lightweight to enable carrying by hand and ready removability of the entire device from the pool when not in use.

4 Claims, 7 Drawing Sheets

(56) References Cited

U.S. PATENT DOCUMENTS

| | | | | |
|---|---|---|---|---|
| 7,082,981 | B2 * | 8/2006 | Perez, Jr. | A01K 1/035 160/24 |
| 7,909,991 | B2 | 3/2011 | Hernandez | |
| 2003/0164485 | A1 * | 9/2003 | Olson | E01F 13/028 256/37 |
| 2003/0209565 | A1 * | 11/2003 | McKay | A47L 25/005 222/192 |
| 2009/0212589 | A1 * | 8/2009 | Winstanley | B60J 1/20 296/97.8 |
| 2009/0233265 | A1 * | 9/2009 | Budryk | B43L 1/00 434/412 |
| 2010/0089842 | A1 * | 4/2010 | Hernandez | E04H 4/1254 210/776 |

* cited by examiner

POOL SKIMMER

BACKGROUND

The present invention is directed to a pool skimmer utilizing a screen or perforated material for skimming floating debris from the surface of a body of water, such as a swimming pool.

A maintenance chore of swimming pool owners is periodically skimming floating debris from the surface of their pool. Most objects of debris that find their way into a swimming pool are generally airborne and, being less dense than water, typically float on a top surface of the pool water, as they primarily comprise leaves, sticks, grass clippings, and other bits of paper, trash, or other organic material.

Skimming operations have conventionally been performed with a scoop-type skimmer which has an elongate handle at one end and a screened pocket supported by a frame at an opposite end. Floating debris is skimmed from random areas of the surface of the pool by manually dipping the pool skimmer into the water and lifting out debris which becomes trapped in the screening. This manual process can be time-consuming, is not efficient for removing all debris, and requires frequent removal of debris from the screen pocket so that the caught debris is not re-introduced to the pool.

Other forms of skimmers include more substantial apparatus permanently mounted on the side walls or decks of pools that extend into the pool and are present within the pool. Such apparatus remains in the pool even when skimming operations are not being performed. Thus, there is a risk with respect to injury of swimmers and/or damage of the apparatus and the apparatus is typically mechanical in nature and not necessarily aesthetically pleasing.

SUMMARY

According to one aspect of the present invention, a device for skimming the surface of a body of water to collect debris floating on the surface is provided. The device includes an elongate handle, a hollow body interconnected to the handle, and a spool on which an elongate continuous length of webbing material is wound in a spiral configuration. The spool is housed within the hollow body and the webbing material is extendable from the spool through a slot formed in the hollow body and is retractable onto the spool through the slot via rotation of the spool within the hollow body. The webbing material has a proximal end to which an end piece is connected. The end piece is of a shape to prevent passage through the slot into the hollow body and has a fastening element for removably securing the end piece to an edge of a structure of the body of water for removably mounting the end piece to the structure. The handle and hollow body are sufficiently portable and lightweight to enable carrying and manipulation of the device by hand and to enable ready removability of the entire device from the body of water when not in use.

According to another aspect of the present invention, a method of making a pool skimming device is provided. The method includes integrally fanning or securing a hollow body on the end of an elongate handle such that the hollow body has an open end and an elongate slot extending from the open end and such that the end of the elongate handle extends within the hollow body. A spool, on which an elongate continuous length of webbing material is wound, is inserted into the open end of the hollow body and onto the end of the handle such that the spool is housed within the hollow body and such that the spool is rotatable about the handle for purposes of extending and retracting the webbing material relative to the hollow body. An end piece is secured to a proximal end of the webbing material. The end piece is of a shape to prevent passage through the slot of the hollow body and has a fastening element for securing the end piece to an edge of a structure of a swimming pool. During the inserting step, the webbing material is inserted into the slot of the hollow body such that the end piece is located exterior of the hollow body.

According to a further aspect of the present invention, a method of skimming a pool of water with a skimming device is provided. The method includes positioning a hand-held portable skimming device adjacent a pool structure. The skimming device has an elongate handle, a hollow body connected to one end of the handle, and a spool within the hollow body on which a continuous elongate length of webbing material is wound in a spiral configuration. The webbing material extends through a slot formed in the hollow body and has a proximal end with an end piece having a fastening element located external of the hollow body. The method further includes the steps of disposing the hand-held skimming device in a substantially vertical position with the hollow body partially submerged within the pool of water and securing the fastening element to the pool structure. After the said securing step, the hand held skimming device including the handle and the hollow body is transported in a path of travel around the perimeter of the pool one time such that the webbing material is automatically extended from and retracted onto the spool to maintain the webbing material in a taut vertical position extending above and below a waterline of the pool along an entire extended length of the webbing material between the end piece and the hollow body to enable debris floating on a surface of the pool to be corralled by the webbing. After a full trip around the pool is completed, the end piece is disconnected from the structure, and the skimming device is entirely removed from the pool.

DETAILED DESCRIPTION

Figure 1:
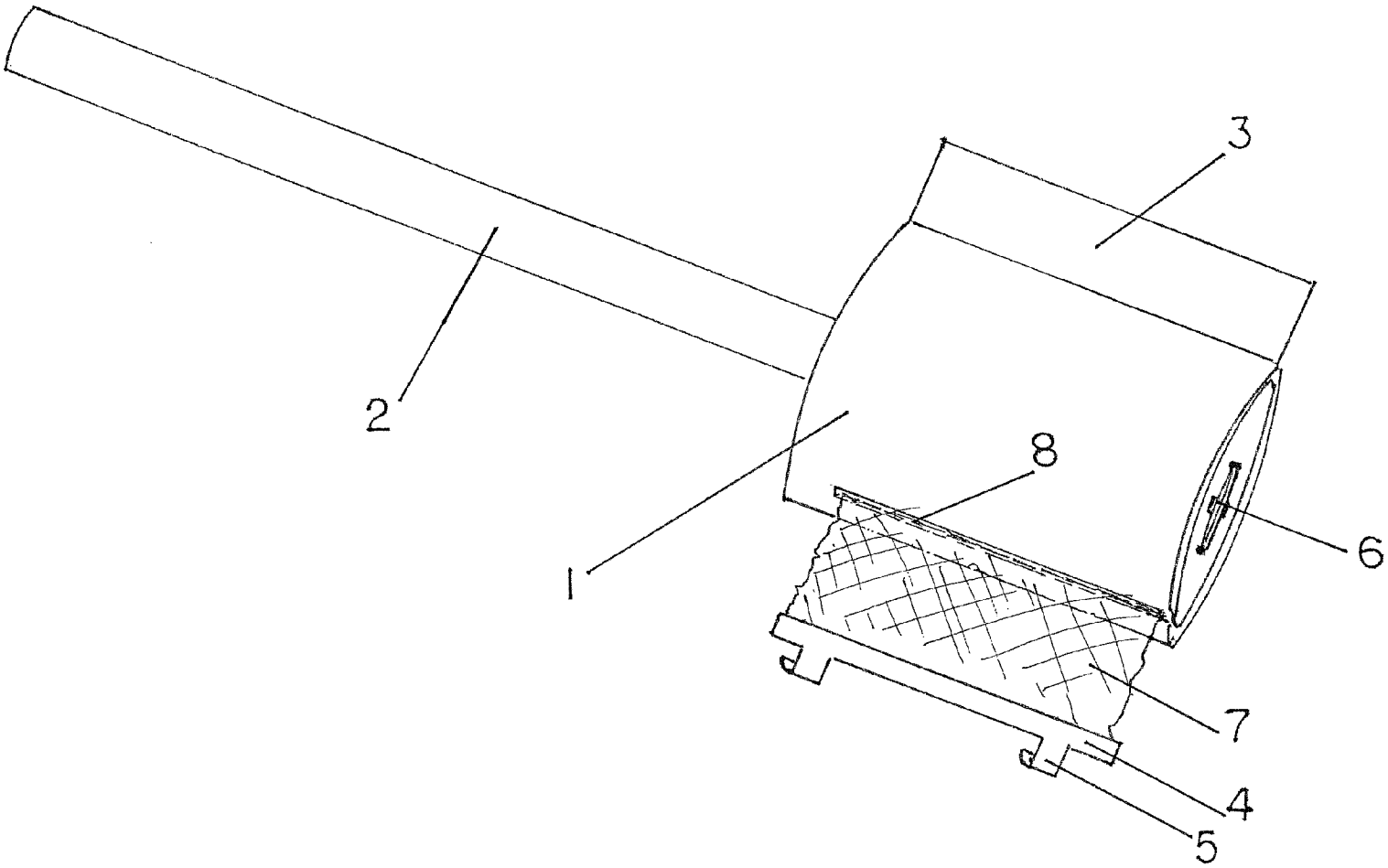
FIG. 1 is a perspective view of a portable pool skimmer according to an embodiment.

A hand-held portable pool skimmer according to an embodiment is shown in FIG. 1. This skimmer can readily be stored in a compact condition in a closet or other storage unit such that, when it is not being used, it can be stored out of sight and away from contact of swimmers and pool users. Thus, no part of the skimmer is required to remain within the pool or other body of water when use of the skimmer is not desired. Rather, it only enters or is present within the pool during a quick skimming operation and is thereafter removed from the pool and conveniently stored.

As best illustrated in FIG. 1, the skimmer includes a hollow body 1 that is substantially cylindrical, a handle 2 extending from the hollow body 1, and a flange or fin 3 projecting from the hollow body 1. The hollow body 1, handle 2, and flange 3 can be integrally molded of plastic or like material and/or can be separately manufactured and assembled. For instance, the handle 2 can be made of wood or like material. As explained below, the flange 3 is designed to contact the wall of the pool during a skimming operation and can be made of plastic or a flexible elastomeric material. The entire skimmer is only a few feet in length end-to-end and is sufficiently lightweight such that it can be easily handled and manipulated.

The hollow body 1 contains a continuous elongate length of webbing, netting, or like perforated material 7 that, in use, can be withdrawn and extended from the hollow body 1 via an open slot 8 which is elongate and formed in the hollow body 1. As an example, the height of the webbing 7 can be about nine inches or like size enabling it to straddle and extend above and below the waterline of a body of water so that all debris can be gathered. Further, as shown in FIGS. 1-4, the handle 2, flange 3 and open slot 8 are designed such that they all extend in the same direction (i.e., parallel to a longitudinal axis of the handle 2). In addition, the flange 3 and open slot 8 are located at diametrically opposed locations on the hollow body 1.

According to some embodiments, the webbing 7 is automatically retractable into the hollow body 1 in a compact wound spiral configuration about a reel or spool 9. A distal end of the webbing 7 is permanently mounted within the hollow body 1 such as to the spool 9 or its core, and a proximal end of the elongate webbing 7 is attached to an end piece 4 which may be made of plastic, elastomeric or like material. The end piece 4 is sized such that it cannot pass through the open slot 8 and entirely into the hollow body 1; rather, it is always positioned and accessible from an exterior of the hollow body 1. In addition, the end piece 4 has one or more hooks 5 or like elements that can be used to catch or be temporarily secured to an edge of a pool cleanout opening or like pool structure.

Figures 2, 3, 4:
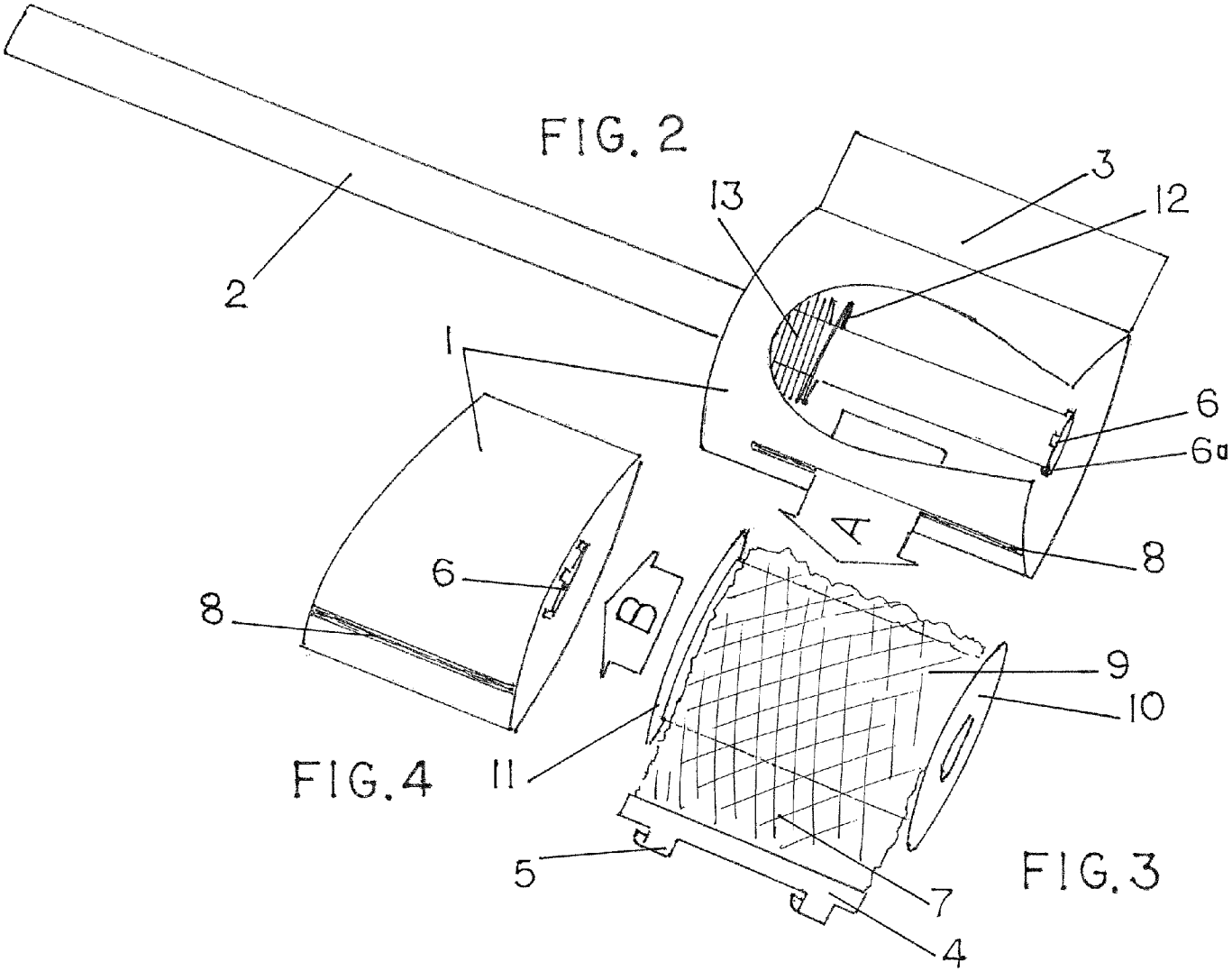
FIGS. 2-4 are perspective views of parts of the pool skimmer according to the embodiment shown in FIG. 1.

When assembled, the spool 9 is housed within the hollow body 1 and is rotatable about a portion of the handle 2 which extends within the hollow body 1. See FIG. 2. The rotation of the spool permits the webbing 7 to be wound onto the spool 9 when being retracted into the hollow body 1 (i.e. in a direction opposite to that marked as "A" in FIG. 2) and extended from the hollow body 1 in a direction "A" through the open slot 8 as shown in FIG. 2.

During assembly, the spool 9 may be slid onto the end of the handle 2 and into the hollow body 1 via an open end of the hollow body 1. See direction "B" in FIG. 4. During this process, a part of the webbing 7 adjacent the end piece 4 can be slid into the open slot 8 which extends from the edge of the open end of the hollow body 1. See FIGS. 3 and 4. When the spool 9 is located within the hollow body 1, it can be locked therein via a locking member or cap 6 having locking tabs 6*a* extending from or connectable to the end of the handle 2.

The spool 9 can be properly positioned within the hollow body 1 by a spring 13 and washer 12 or the like such that the webbing 7 is always in proper alignment with the open slot 8. See FIG. 2. The spring 13 also exerts an amount of active resistance to the spool 9 needed to keep the webbing 7 taut when extended from the hollow body 1. The washer 12, which may be made of plastic, engages one end wall 11 of the spool 9 while the locking member of cap 6 engages the opposite end wall 10 of the spool 9. In this assembled condition, the end wall 10 of the spool 9 forms an end wall of the hollow body 1. Although not shown, the spool 9 can have internal mechanisms for securing the distal end of the webbing 7 to the spool 9 and for providing a substantially constant force such that the spool rotates under normal conditions to automatically cause any extended part of the webbing 7 exterior to the hollow body 1 to retract within the hollow body 1 onto the spool 9.

Figure 5:
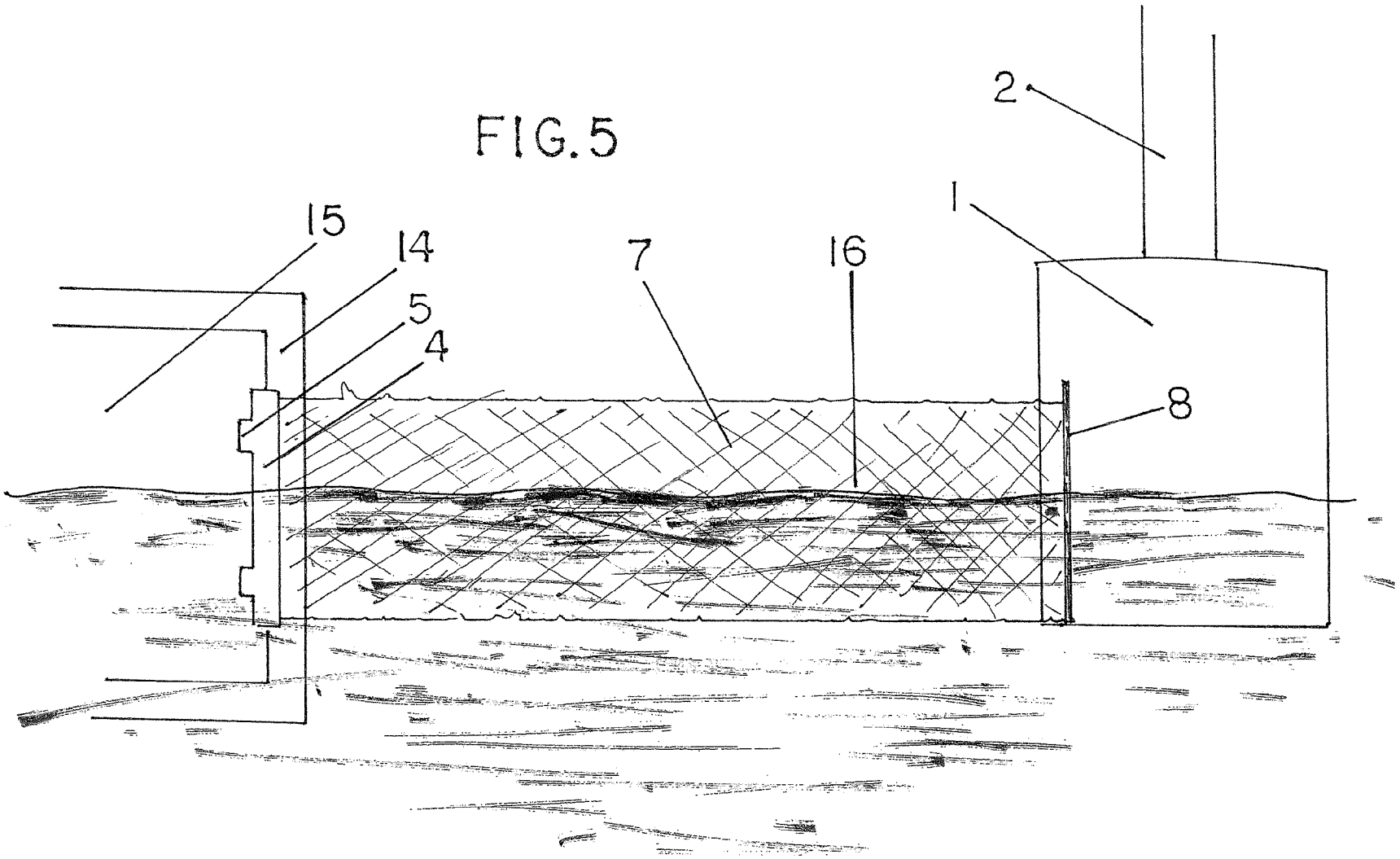
FIG. 5 is an elevational view of the portable pool skimmer of FIG. 1 in use in a pool in accordance to an embodiment.

Many pools have so-called cleanouts or the like which can be used to catch, collect and/or remove debris from the pool surface. Typically such cleanouts extend within the sidewalls of pools adjacent the waterline of the pool. For example, a portion of a pool shown in FIG. 5 has a cleanout opening 15 formed in a sidewall of a pool at a location extending above and below the waterline 16 of the pool. The cleanout has a rim 14 defining and encircling the cleanout opening 15.

During use of the skimmer, a person standing on decking or the like adjacent an edge of a pool adjacent a location of a cleanout opening 15 can hold the skimmer by its handle 2 in a substantially vertical disposition with the hollow body 1 of the skimmer directly downward such that the hollow body 1 is partially submerged within the pool water and straddles across the waterline 16. In this position, the hooks 5 of the end piece 4 can be readily engaged and secured to an edge of the rim 14 of the cleanout opening 15. See FIG. 5. As the person holding the portable skimmer walks along the outer perimeter of the pool leading away from location of the cleanout opening 15, the webbing 7 is caused to be extended from the hollow body 1 by forced rotation of the spool 9 and via the open slot 8 such that about half of the height of the webbing 7 is submerged in water below the waterline 16 and about half of the height of the webbing 7 projects above the waterline 16. See FIG. 5. In this condition, the webbing 7 is taut and in position to corral debris 18.

Figure 6:
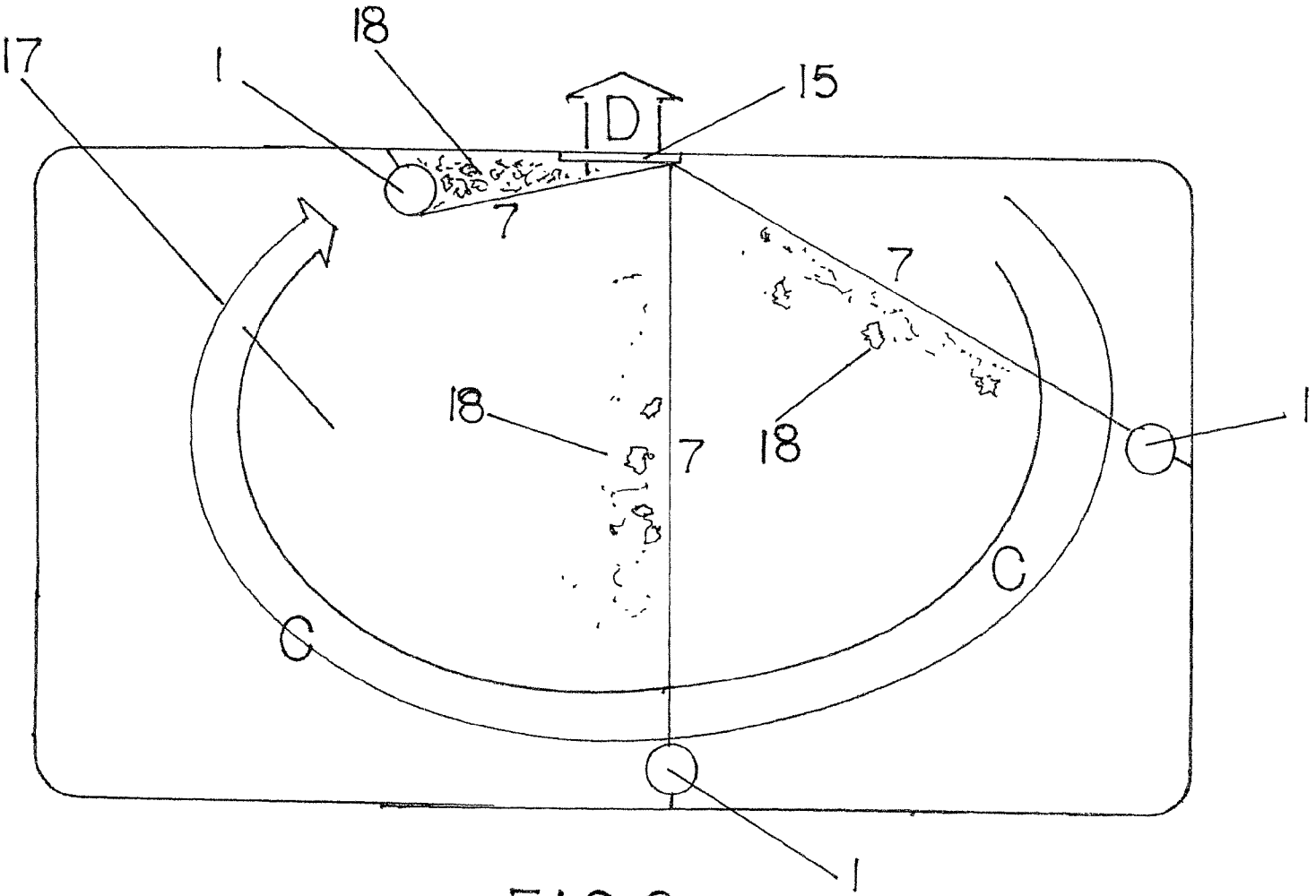
FIG. 6 is a plan view of a pool showing the path of travel of the pool skimmer of FIG. 1 in accordance to an embodiment.

The person holding the skimmer walks or otherwise traverses a path of travel encircling the perimeter of the pool for one substantially complete loop, such as in a direction "C" for pool 17 shown in FIG. 6. The flange or fin 3 extending from the hollow body 1 of the skimmer can be pointed toward the user and positioned in contact with the wall of the pool for purposes of catching all debris, such as debris 18 shown in FIG. 6. As shown in FIG. 6, the end piece 4 of the webbing 7 remains secured to the cleanout rim 14 and the webbing 7 is automatically fed out from the hollow body 1 under the force exerted by the user walking away from the cleanout opening 15. As the user traverses the perimeter of the pool 17, the webbing 7 always remains in a substantially taut condition due to self-regulated rotation of the spool 9 within the hollow body 1 of the skimmer and extends in a substantially straight line between the location of the end piece 4 (at the cleanout opening 15) and the location of the hollow body 1 (which travels with the user) such that about half of the webbing 7 is submerged below the waterline and about half of the webbing 7 projects from the waterline throughout the entire extended length of the webbing 7. This ensures that all floating debris 18 is captured by the webbing 7.

For purposes of example of the progression of the user about a perimeter of the pool 17, a first position of the webbing 7 and hollow body 1 is shown in FIG. 6 extending toward the right edge of the pool 17, a second position of the skimmer (at a half way position around the pool 17) is shown along the bottom edge of the perimeter of the pool 17 shown in FIG. 6, and a third position (nearing completion) is shown in the upper left edge of the perimeter of the pool 17. In all these positions, the skimmer self-regulates feed-out and take-up of the webbing 7 such that the webbing 7 extending from the skimmer always remains in a substantially taut condition. Thus, webbing 7 is feed-out and taken-up automatically during this process. Accordingly, the webbing 7 is able to sweep all floating debris from the surface of the pool and never flattens-out or sinks which would permit debris to escape the webbing 7.

After the user has almost encircled the pool 17 of FIG. 6, the floating debris is captured by the webbing 7 and is corralled to a location adjacent the cleanout opening 15 where it can readily be forced to exit the pool 17 via the cleanout opening 15. See direction "D" labeled in FIG. 6. Upon completion, the portable hand-held skimmer can be unhooked or unattached from the cleanout rim 14, entirely removed from the pool, and placed in a closet or like storage unit out of sight and the way of pool users.

Figure 7:
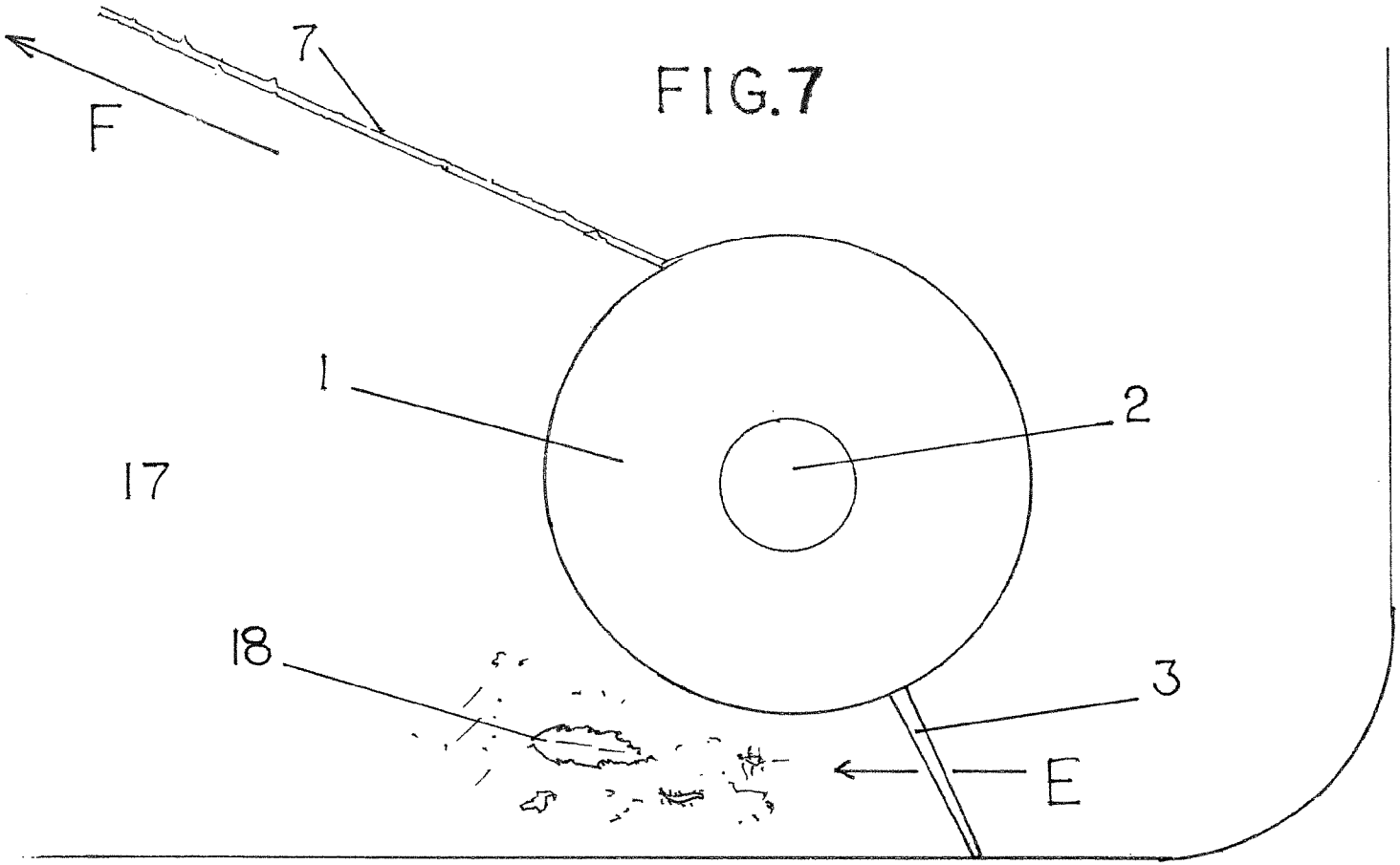
FIG. 7 is a plan view of the portable pool view in use in accordance to an embodiment.

During the above skimming operation, the flange or fin 3 extending from the hollow body 1 of the skimmer can be positioned by the user in sliding engagement with the side wall or other surface of the pool edge. See FIG. 7. Thus, as the skimmer is moved in direction "E" in the pool 17 shown in FIG. 7, the debris 18 is captured and cannot escape between any spacing between the pool edge and the hollow body 1. In FIG. 7, a force "F" is shown acting on the webbing 7 for purposes of ensuring that the webbing 7 extended from the hollow body 1 remains taut and upright in the water straddling both sides of the waterline such that all debris is captured.

Figure 8:
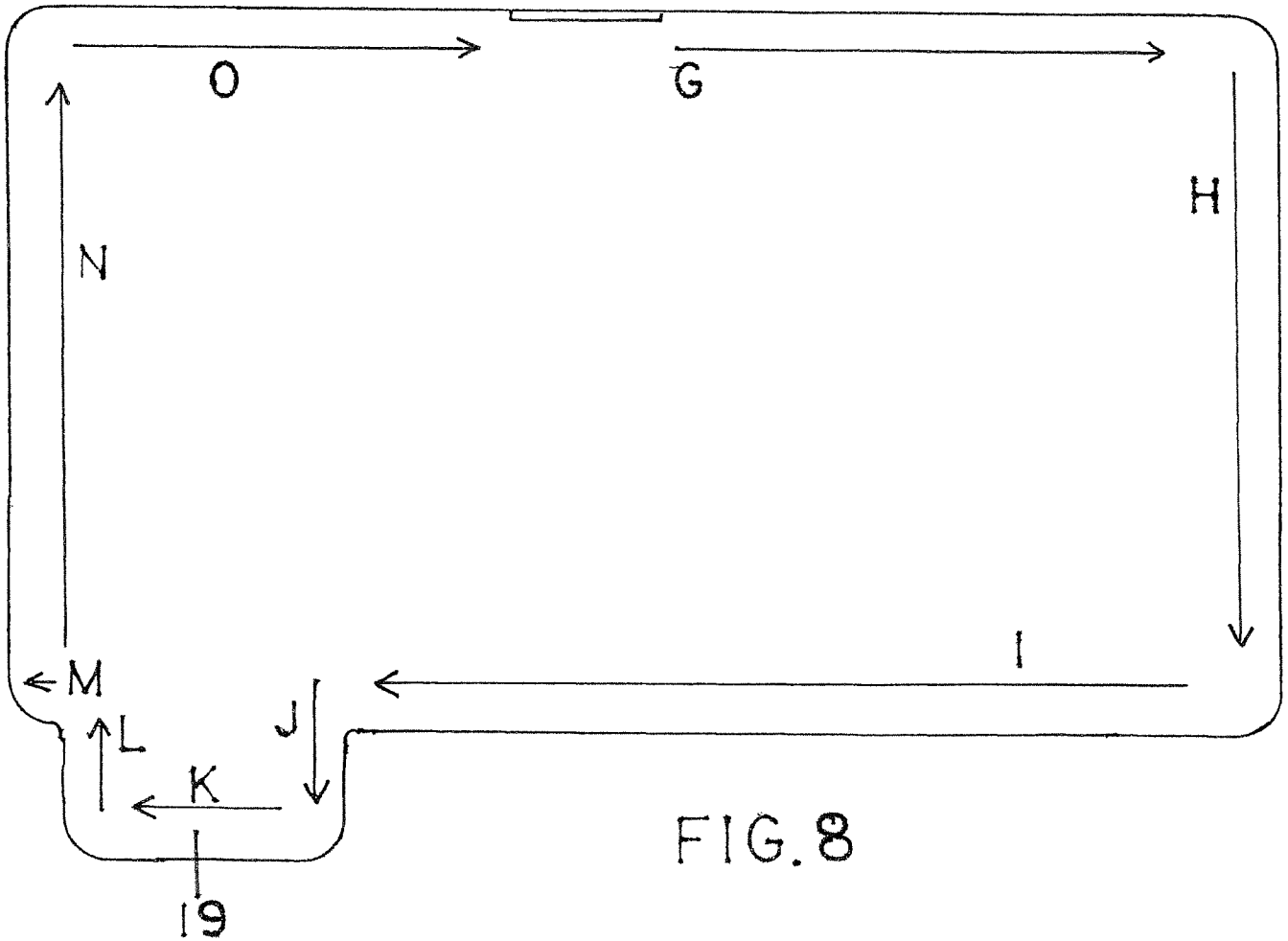
FIG. 8 is a plan view of a pool showing the path of travel of the pool skimmer of FIG. 1 in accordance to an embodiment.

The above described portable hand-held skimmer can be used on any pool having any perimeter shape. For instance, a pool is shown in FIG. 8 having pool steps 19 affecting the shape of the perimeter of the pool. Here, a user encircles the perimeter of the pool, starting at the cleanout opening, and moves the skimmer along a path labeled as G, H, I, J, K, L, M, N and O. See FIG. 8.

Figure 9:
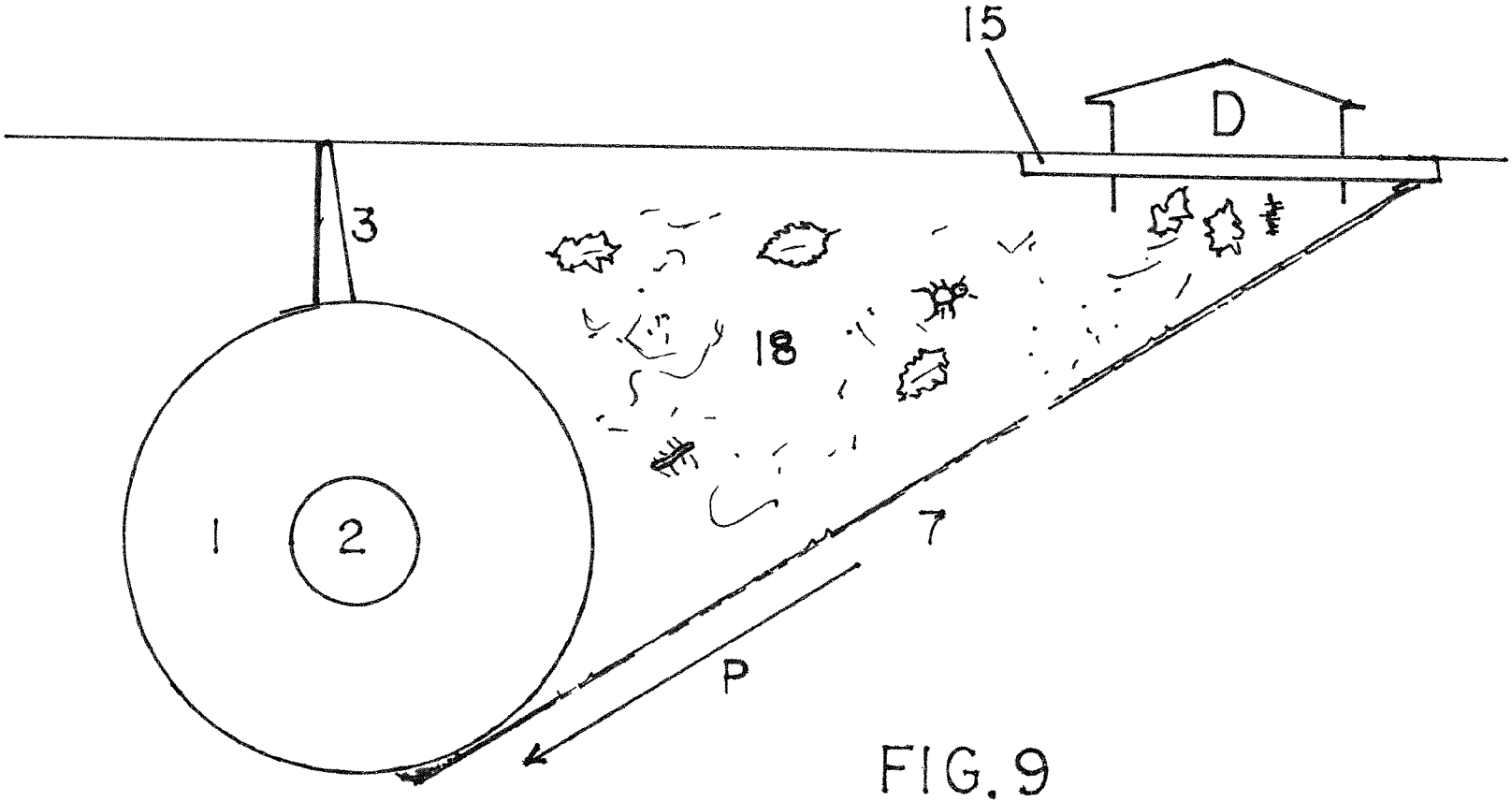
FIG. 9 is a plan view of the portable pool view in use in accordance to an embodiment.

FIG. 9 shows that the webbing 7 remains under tension as the hollow body 1 approaches the cleanout opening 15. The debris 18 is corralled by the webbing 7 which is progressively retracted into the hollow body 1 (see direction "P") as the skimmer approaches the cleanout opening 15. The debris 18 is ultimately forced through the cleanout opening 15 in direction "D" by the webbing 7 for removal from the pool.

As described above, the skimmer reduces time and difficulty of skimming a pool surface and ensures that substantially all floating debris is efficiently captured on a single pass and removed via one quick walk about the perimeter of the pool (which may take a minute or less depending on pool size). The length of the webbing 7 can be designed and selected based on the size of pool to be skimmed.

Various alternations may be made to the skimmer described above. For example, the hooks 5 can be replaced with other securement mechanisms, such as, clamps, ties, hook and loop fasteners, mechanical fasteners, and the like and can be secured to structures other than the rims of cleanout openings. An alternate embodiment of the skimmer can include making the handle and hollow body separate units interconnected by the webbing. Thus, the hollow body can be hooked to the rim of the cleanout opening and remain substantially stationary at the location of the cleanout opening while the handle is connected to an end of the webbing and is moved about the perimeter of the pool. However, even with this embodiment, the hollow body and handle are portable and no part remains attached to the pool when not in use.

The foregoing description and specific embodiments are merely illustrative of the principles thereof, and various modifications and additions may be made to the apparatus by those skilled in the art, without departing from the spirit and scope of this invention.

I claim:

1. A device for skimming the surface of a body of water to collect debris floating on the surface, comprising:

an elongate handle having a proximal end, a distal end, and a longitudinal axis, said distal end having a plurality of locking tabs extending circumferentially therefrom;

a hollow body interconnected to the handle such that the distal end of the handle extends within the hollow body, the proximal end of the handle extends exterior of the hollow body providing a grippable surface, and the hollow body travels with the handle during a skimming operation;

a spool on which an elongate continuous length of webbing is wound, said spool being housed within said hollow body and said webbing being extendable from the spool through a slot formed in the hollow body and automatically retractable onto the spool through said slot via rotation of said spool within said hollow body, and the distal end of the handle that extends within the hollow body extends through said spool and forms an axis about which the spool is located and rotates;

a spring and washer extending about the distal end of the handle and located within the hollow body for properly aligning the spool within the housing and for urging an opposite end of the spool against said locking tabs which prevent release of the spool from the handle;

a flange made of a strip of elastomeric material and extending outwardly from the hollow body, parallel to said slot and longitudinal axis of said handle, and at a location on the hollow body diametrically opposed from said slot; and said webbing having a proximal end to which an end piece is connected, said end piece being of a shape to prevent passage through said slot into the hollow body and having a fastening element for securing said end piece to an edge of a structure of the body of water for removably mounting the end piece to the structure; and said handle and hollow body being sufficiently portable and lightweight to enable carrying and manipulation of the device by hand and to enable ready removability of the entire device from the body of water when not in use.

2. The device according to claim 1, wherein said fastening element of said end piece is at least one of a hook, a clamp, a tie, a mechanical fastener, and a hook and loop fastener.

3. The device according to claim 1, wherein the webbing is an elongate continuous length of netting or flexible perforated material.

4. The device according to claim 1, wherein the strip of elastomeric material is solid and extends a full length of said hollow body.

* * * * *